US009986843B2

(12) United States Patent
Baker

(10) Patent No.: US 9,986,843 B2
(45) Date of Patent: Jun. 5, 2018

(54) FOLDING STEP STOOL

(71) Applicant: JOBAR INTERNATIONAL, INC., Carson, CA (US)

(72) Inventor: Tim Alan Baker, Torrance, CA (US)

(73) Assignee: JOBAR INTERNATIONAL, INC., Carson, CA (US)

( * ) Notice: Subject to any disclaimer, the term of this patent is extended or adjusted under 35 U.S.C. 154(b) by 43 days.

(21) Appl. No.: 15/170,319

(22) Filed: Jun. 1, 2016

(65) Prior Publication Data

US 2017/0215594 A1 Aug. 3, 2017

Related U.S. Application Data

(60) Provisional application No. 62/289,023, filed on Jan. 29, 2016.

(51) Int. Cl.
*A47C 12/00* (2006.01)

(52) U.S. Cl.
CPC ..... *A47C 12/00* (2013.01)

(58) Field of Classification Search
CPC ..... A47C 12/00; A47C 12/02
USPC ..... 297/42, 350; 248/150, 165, 346.3, 460, 248/529
See application file for complete search history.

(56) References Cited

U.S. PATENT DOCUMENTS 1,133,109 A * 3/1915 Derbyshire ..... A47B 3/0912 108/132
1,786,458 A 12/1930 Shipman
3,805,711 A * 4/1974 Lakso ..... A47B 23/001 108/133
4,630,861 A 12/1986 Henschel
D371,176 S 6/1996 Furner
5,797,649 A * 8/1998 Snell, Jr. ..... B60N 2/3043 296/63
6,182,724 B1 * 2/2001 Chou ..... B25H 1/04 108/115
D460,566 S 7/2002 Henschel et al.
6,854,797 B1 * 2/2005 Thomas ..... A47C 4/34 297/16.1
D579,680 S 11/2008 Emert
D582,168 S 12/2008 Sandel
(Continued)

OTHER PUBLICATIONS

Kennedy home collection; Style # 3576, owned by examiner's supervisor and copyrighted 2009 and 2010 per attached photographs of actual stool and attached label, photo #1—1 page.*
(Continued)

*Primary Examiner* — Katherine W Mitchell
*Assistant Examiner* — Shiref M Mekhaeil
(74) *Attorney, Agent, or Firm* — Lewis Roca Rothgerber Christie LLP

(57) ABSTRACT

A folding step stool includes a foldable top wall including a first section hingeably coupled to a second section along a first axis. A first side wall is hingeably coupled to the first section. A second side wall is hingeably coupled to the second section. A third foldable side wall is hingeably coupled to the first side wall and the second side wall. A fourth foldable side is hingeably coupled to the first side wall and to the second side wall. A foldable supporting member includes a first section hingeably coupled to the foldable top wall first section and a second section hingeably coupled to the foldable top wall second section.

11 Claims, 5 Drawing Sheets

(56) References Cited

U.S. PATENT DOCUMENTS

| | | | | |
|---|---|---|---|---|
| 7,497,514 | B2 * | 3/2009 | Ramsey | A47C 4/52 297/17 |
| D615,667 | S | 5/2010 | Dunn et al. | |
| D639,080 | S | 6/2011 | van der Laude | |
| D665,180 | S | 8/2012 | Ekelchik | |
| 8,496,289 | B2 * | 7/2013 | Chen | A47B 3/083 108/130 |
| D707,975 | S | 7/2014 | Habraken | |
| D751,309 | S | 3/2016 | Habraken | |
| 9,648,958 | B2 * | 5/2017 | Pectol | A47C 9/10 |
| 2004/0231918 | A1 * | 11/2004 | Meeker | A47C 12/02 182/33 |
| 2009/0261643 | A1 * | 10/2009 | Kay | A47C 9/10 297/335 |
| 2010/0187041 | A1 * | 7/2010 | Crouch | A47D 15/003 182/223 |
| 2013/0048428 | A1 * | 2/2013 | Chancler | A47C 9/10 182/155 |
| 2014/0131138 | A1 * | 5/2014 | Simpson | A47C 12/00 182/223 |
| 2015/0083522 | A1 * | 3/2015 | Chancler | A47C 12/00 182/152 |
| 2016/0309903 | A1 * | 10/2016 | Huang | A47C 12/00 |
| 2017/0215594 | A1 | 8/2017 | Baker | |

OTHER PUBLICATIONS

Kennedy Style 3576 Recall notice , downloaded from https://www.cpsc.gov/Recalls/2012/kennedy-international-recalls-folding-step-stools-due-to-fall-hazard# , published and recalled May 10, 2012. Photo #2—1 page.*

Kennedy home collection; Style # 3576; Photo 3—top Isometric view with handle, Photo 4—top Isometric, Photo 5—top Isometric with sticker, Photo 6—top Isometric with all 4 stickers, Photo 7—top Isometric zoomed view.Photo 8—Barcode with 2010 date, -6 pages.*

Kennedy home collection; Style # 3576; Photo 9—Lower surface, Photo 10—Ramp and stop, Photo 11—Ramp and stop zoomed view, Photo 12—General lower surface. -4 pages.*

Ebay, 16"H Plastic Foldable Folding Fold Step Stool Chair Carry Design for Camping BBQ, http://www.ebay.com/itm/16-H-Plastic-Foldable-Folding-Fold-Step-Stool-Chair-Carry-Design-for-Camping-BBQ-/191598552937?var=&hash=item2c9c29e769:m:mrEtHT0kZYqoui4HPc6ckKw, 1 page.

Simon, Kikkerland Folding Stool, http://www.betterlivingthroughdesign.com/furnishings/kikkerland-folding-stool/, Mar. 23, 2010, 1 page.

Amazon, Honey-Can-Do TBL-02977 Folding Step Stool with Anti-Slip Surface, 12.8-Inch, http://www.amazon.com/Honey-Can-Do-TBL-02977-Folding-Anti-Slip-12-8-Inch/dp/B00CRVL7IE, 1 page.

The Container Store, Black Easy Folding Step Stool, http://www.containerstore.com/s/laundry/step-stools-ladders/easy-fold-step-stool/12d?productId=10025591, 1 page.

WalterDrake, WalterDrake Folding Step Stool, http://www.walmart.com/ip/Miles-Kimball-Black-Folding-Step-Stool/38376860, 2 pages.

Wellness 4 Plastic Portable Folding Step. [online] Retrieved Dec. 1, 2017 from URL: https://www.staples.com/North-American-Health-Wellness-4-Plastic-Portable-Folding-Step-ZB7571/product 2446926, 3 pages.

Simplify Striped Folding Step Stool with Handle. [online] Retrieved Dec. 1, 2017 from URL: https://www.walmart.com/ip/Simplify-Striped-Folding-Step-Stool-with-Handle/38252060, 11 pages.

* cited by examiner

FOLDING STEP STOOL

CROSS-REFERENCED TO RELATED APPLICATION

This application claims priority to and the benefit of U.S. Provisional Application Ser. No. 62/289,023, filed on Jan. 29, 2016, entitled FOLDING STEP STOOL, the contents of which are incorporated by reference in their entirety.

BACKGROUND

Older people or people who are less mobile often have a hard time getting out of a vehicle, such as a car or a sport utility vehicle that is higher off the ground. They have a hard time stepping off and reaching the ground. While a stool may be provided, stools typically occupy a lot of space and may be cumbersome to handle. Thus, a stool that is folding and does not take a lot of space may be desired.

SUMMARY

In an example embodiment a folding step stool is provided. The folding step stool includes a foldable top wall including a first section hingeably coupled to a second section along a first axis. A first side wall is hingeably coupled to the first section. A second side wall is hingeably coupled to the second section. A third foldable side wall includes a first section hingeably coupled to a second section, wherein the third foldable side wall first section is hingeably coupled to the first side wall and wherein the third foldable side wall second section is hingeably coupled to the second side wall. A fourth foldable side wall includes a first section hingeably coupled to a second section, wherein the fourth foldable side wall first section is hingeably coupled to the first side wall and wherein the fourth foldable side wall second section is hingeably coupled to the second side wall. A foldable supporting member includes a first section hingeably coupled to the foldable top wall first section and includes a second section hingeably coupled to the foldable top wall second section. In another example embodiment, the foldable supporting member first section is hingeably coupled to the foldable supporting member second section. In yet a further example embodiment, the foldable top wall first section is hingeably coupled to the foldable top wall second section along a first axis. In another example embodiment, the first side wall is hingeably coupled to the foldable top wall first section about a second axis generally parallel to the first axis and the second side wall is hingeably coupled to the foldable top wall second section about a third axis generally parallel to the first axis. In yet another example embodiment, the first side wall is hingeably coupled to an end of the first section of the foldable top wall and the second side wall is hingeably coupled to an end of the second section of the foldable top wall. In one example embodiment, the first section of the third foldable side wall is hingeably coupled to the first side wall about a fourth axis extending transversely relative to the second axis and the second section of the third foldable side wall is hingeably coupled to the second side wall about a fifth axis extending transversely relative to the third axis. In yet a further example embodiment, the first section of the fourth foldable side wall is hingeably coupled to the first side wall about a sixth axis extending transversely relative to the second axis and the second section of the fourth foldable side wall is hingeably coupled to the second side wall about a seventh axis extending transversely relative to the third axis. In yet another example embodiment, the first section of the foldable third side wall is hingeably coupled to the second section of the foldable third side wall about an eight axis generally perpendicular relative to the first axis, and the first section of the fourth foldable side wall is hingeably coupled to the second section of the fourth side wall about a ninth axis generally perpendicular relative to the first axis. In a further example embodiment, the foldable top wall first and second sections include an upper surface for being stepped on when the foldable stool is in an unfolded useable state, and a lower surface opposite the upper surface, wherein the foldable supporting member is coupled to and extends from the lower surfaces of the first and second sections, and extends in a direction opposite the upper surface of the first and second sections. In yet a further example embodiment, the first section of the top wall includes a handle and wherein the second section of the top wall includes a depression, wherein the handle is received in the depression when the folding step stool is in an unfolded state. In one example embodiment, the foldable top wall first and second sections include an upper surface for being stepped on when the foldable stool is in an unfolded useable state, and a lower surface opposite the upper surface, and the folding step stool further includes, a first ramp extending from the lower surface adjacent to the first section of the third foldable side wall, a second ramp extending from the lower surface adjacent the second section of the third foldable side wall, a third ramp extending from the lower surface adjacent to the first section of the fourth foldable side wall, and a fourth ramp extending from the lower surface adjacent the second section of the fourth foldable side wall. In a further example embodiment, the folding step stool further includes, a first stop adjacent to the first ramp for blocking the first section of the third foldable side wall from pivoting past the first stop when the folding step stool is in a useable unfolded state, a second stop adjacent to the second ramp for blocking the second section of the third foldable side wall from pivoting past the second stop when the folding step stool is in a useable unfolded state, a third stop adjacent to the third ramp for blocking the first section of the fourth foldable side wall from pivoting past the third stop when the folding step stool is in a useable unfolded state, and a fourth stop adjacent to the fourth ramp for blocking the second section of the fourth foldable side wall from pivoting past the first stop when the folding step stool is in a useable unfolded state. In one example embodiment, the folding step stool further includes, a first stop for blocking the first section of the third foldable side wall from pivoting past the first stop when the folding step stool is in a useable unfolded state, a second stop for blocking the second section of the third foldable side wall from pivoting past the second stop when the folding step stool is in a useable unfolded state, a third stop for blocking the first section of the fourth foldable side wall from pivoting past the third stop when the folding step stool is in a useable unfolded state, and a fourth stop for blocking the second section of the fourth foldable side wall from pivoting past the first stop when the folding step stool is in a useable unfolded state.

DETAILED DESCRIPTION

Figure 1:
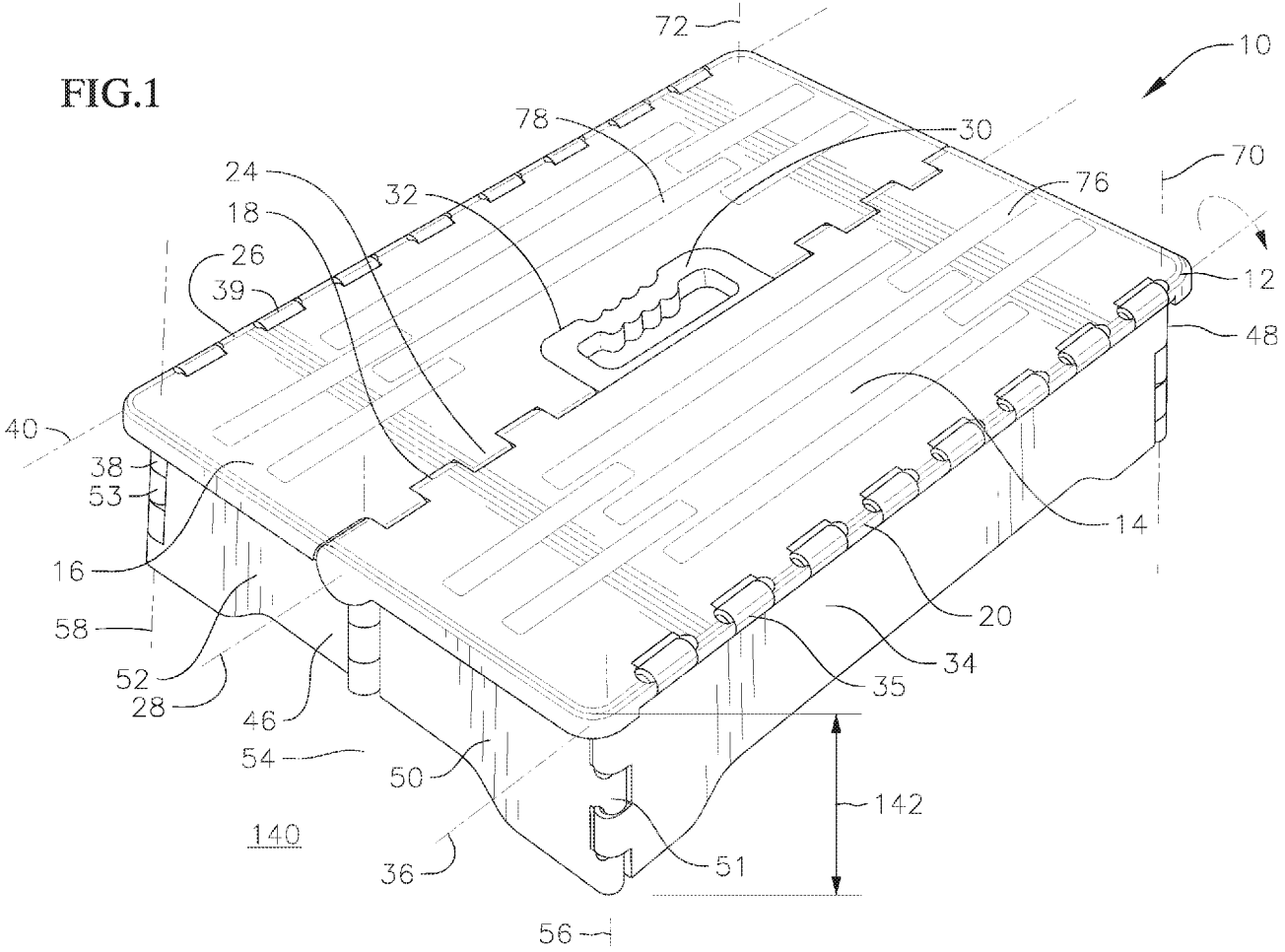
FIG. 1 is a top perspective view of an example embodiment folding step stool.

In an example embodiment as shown in FIG. 1, a folding step stool 10 is provided. The folding step stool includes a foldable top wall 12, which includes a first section 14 hingeably or pivotably (collectively or individually "hingeably") connected to a second section 16. The first section has a first end 18 opposite a second end 20. The second section has a first end 24 opposite a second end 26. The two sections are hingeably coupled together about their first ends along a first axis (or first hinge axis) 28. It should be understood that hingeably coupled about an end as used herein means hingeably coupled about the end or about proximate the end. In an example embodiment, a handle 30 extends from the first section first end and a depression 32 extends from the second section second section first end. The depression may be a cut-out. The depression is designed to receive the handle when the stool is in an unfolded state, i.e., it is in a useable state as shown in FIG. 1. In an example embodiment, the recess has a shape complementary to the shape of the handle.

The example embodiment folding step stool includes a first side wall 34 having an end 35 that is hingeably coupled to the second end 20 of the first section of the top wall along a second axis 36 that is generally parallel to the first axis 28. A second side wall 38 has an end 39 that is hingeably coupled to the second end 26 of the second section of the top wall about a third axis 40 that is generally parallel to the first axis 28.

The example embodiment foldable stool shown in FIG. 1 also includes a third foldable side wall 46 opposite a fourth foldable side wall 48. The third foldable side wall also includes a first section 50 hingeably coupled to a second section 52 about a fourth axis 54 extending perpendicularly (or transversely in another example embodiment) from the first axis 28. The first section 50 of the third side wall has an end 51 that is also hingeably coupled to the first side wall 34 along a fifth axis 56 extending perpendicularly (or transversely) from the second axis 36. The second section 52 of the third foldable side wall has an end 53 that is also hingeably coupled to the second side wall 38 along a sixth axis 58 extending perpendicularly (or transversely) from the third axis 40. The fourth folding side wall in an example embodiment is identical to the third folding side wall. The fourth folding side wall first section has an end that is hingeably coupled to the first side wall about a seventh axis 70 extending perpendicularly (or transversely) from the second axis 36. The fourth side sidewall second section also has an end that is hingeably connected to the second side wall 38 about an eighth axis 72 extending perpendicularly (or transversely) from the third axis 40.

Figure 2:
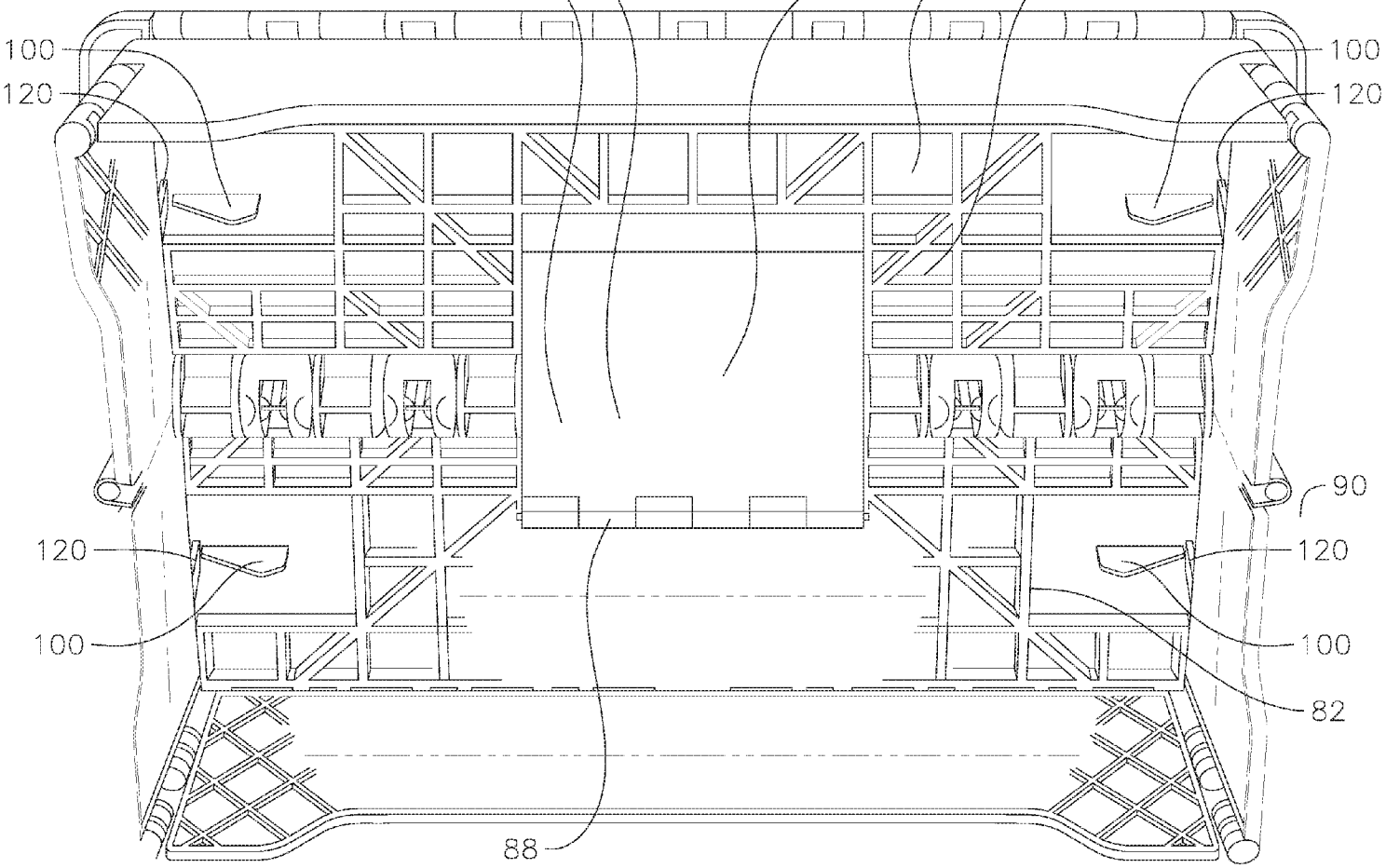
FIG. 2 is a bottom perspective view of the example embodiment folding step stool shown in FIG. 1.
Figure 3:
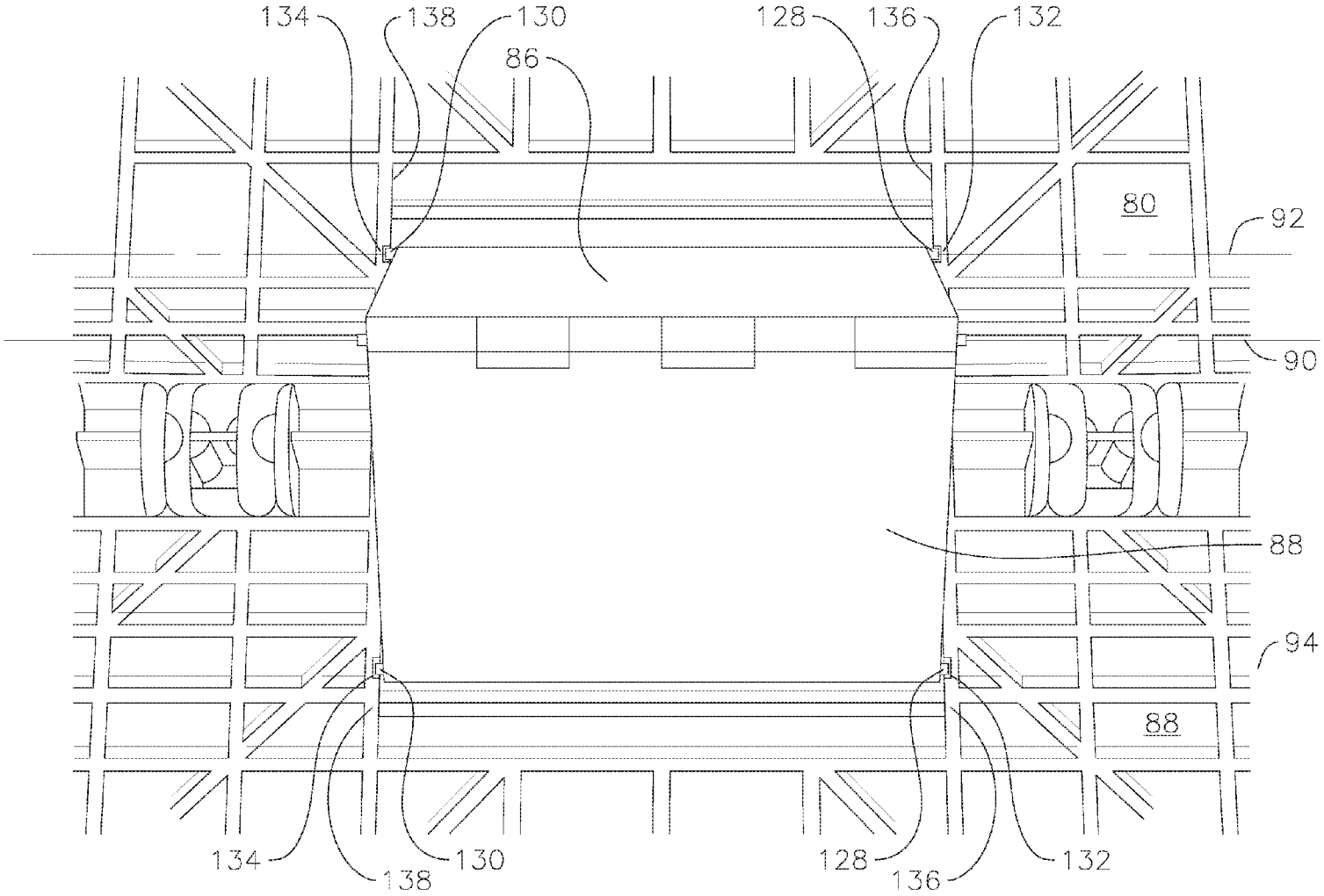
FIG. 3 is a plan view of an example embodiment folding support member incorporated in an example embodiment folding step stool.

The foldable top wall first and second sections 14, 16 each include an upper surface 76, 78 which is the stepping-on surface opposite a corresponding lower surface 80, 82 (FIGS. 2 and 3). In an example embodiment, a foldable supporting member 84 is hingeably coupled to the first folding side wall first and second section lower surfaces 80, 82. The foldable supporting member includes a first section 86 that is hingeably coupled to a second section 88 about a ninth axis 90 generally parallel to the first axis 28. The supporting foldable member first section 86 is hingeably coupled to the lower surface 80 of the first section of the top wall along a tenth axis 92. The foldable supporting member second section 88 is hingeably coupled to the lower surface 82 of the second section of the top wall along an eleventh axis 94 (FIG. 3). In the example embodiment, the tenth and eleventh axes are generally parallel to the first axis 28 and the ninth axis 90. In the example embodiment the tenth and eleventh axes are equidistant from the first axis 28 and they are also equidistant from the ninth axis 90. When a person's weight is put on the stepping surface or upper surface of the top wall, the supporting foldable member provides additional support preventing the two sections from further flexing or folding toward the floor.

Figure 4:
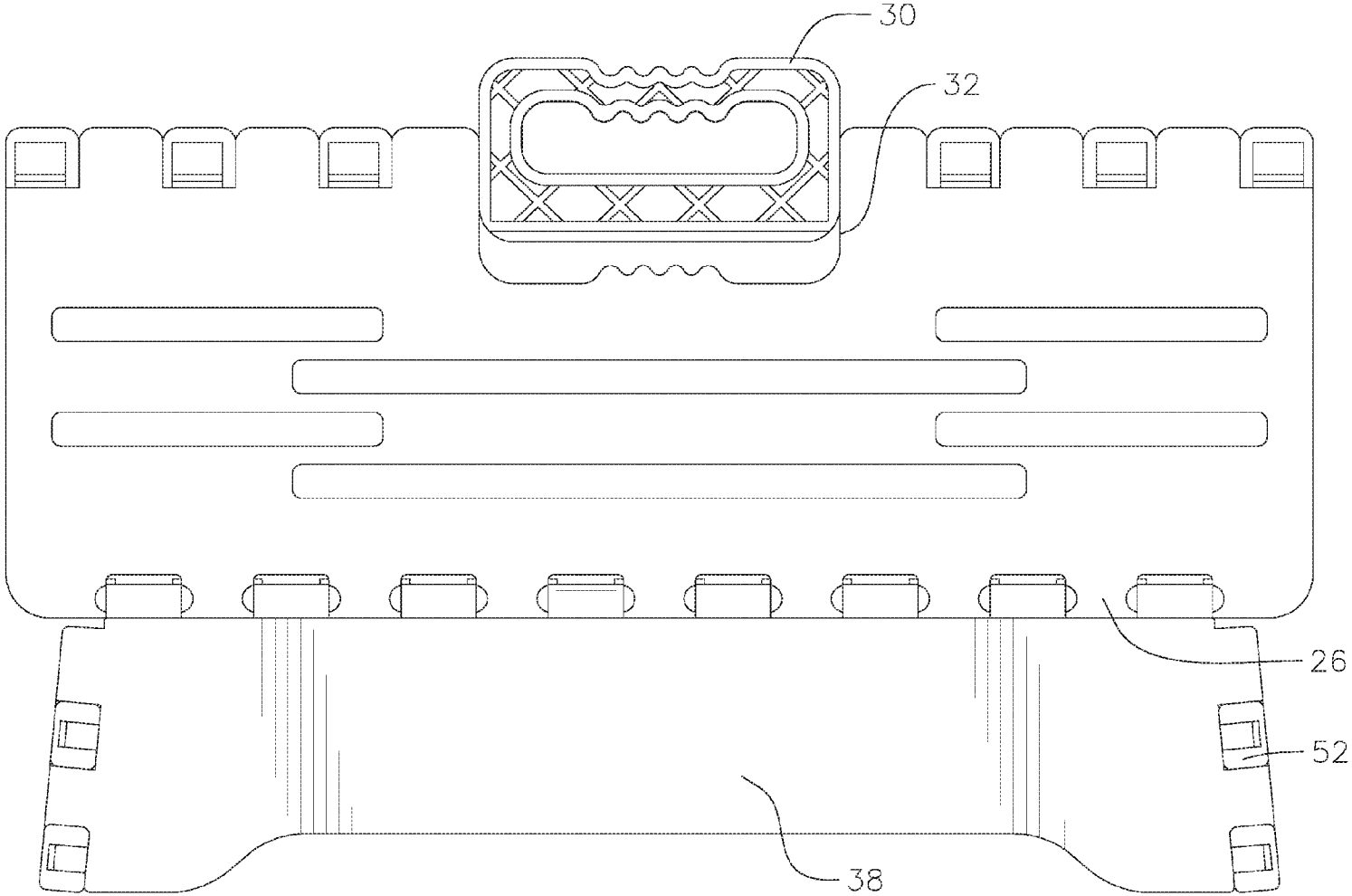
FIG. 4 is a side view of the example embodiment folding step stool of FIG. 1 in a folded state.

In the shown example embodiment, when the folding step stool is in the extended useable position, the handle 30 is fitted within the recess 32, as for example shown in FIG. 1. To collapse the stool, the handle is lifted out of the recess. That causes the top wall first section to fold relative to the top wall second section and the third and fourth foldable side walls to fold inwards along their hinge axes such that the folding step stool extends and collapses to a relatively flat structure, and the foldable supporting member to fold along axis 90, as for example shown in FIG. 4. As the stool folds to a relatively flat structure, the first and ninth axes move away from each other.

Figure 5:
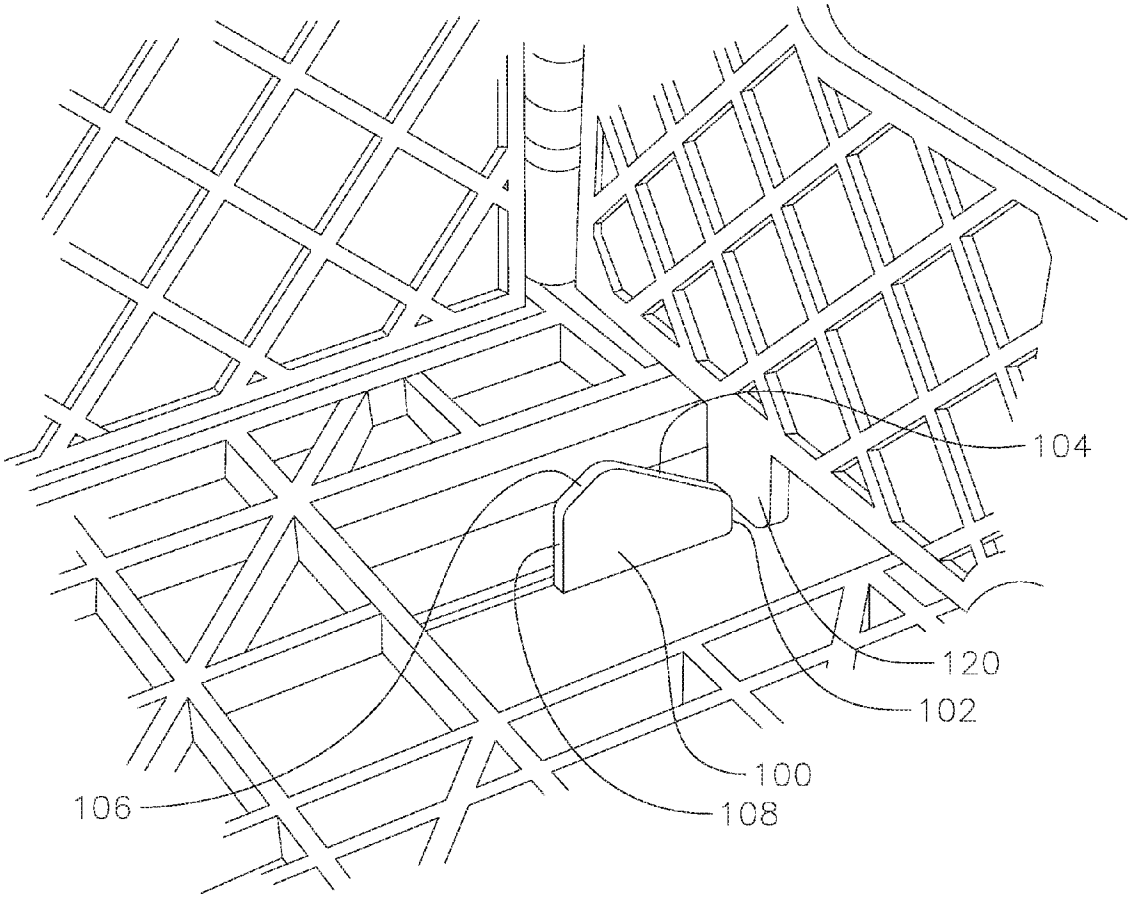
FIG. 5 is a perspective view of a ramp incorporated in an example embodiment folding step stool.

To prevent the stool from accidentally folding when in use, four ramps 100 extend from the lower surfaces of the top wall first and second sections such that a ramp 100 is adjacent each of the sections of the third and fourth folding side walls (FIG. 2). Each of the ramps 100 includes a first edge 102 facing its corresponding section the folding sidewalls (FIG. 5). A ramp edge 104 extends from the first edge 102 to a second edge 106 from which extends a third edge 108. The ramp edge increases in height in a direction from the first edge toward the second edge. In one example embodiment each ramp has a first edge opposite a second edge and a ramp edge there between. In another example embodiment, instead of edges each ramp may have surfaces such as a front surface instead of a front edge, or a ramp surface instead of ramp edge When weight is put on the top wall, the first edge 102 of each ramp extends adjacent to a section of the foldable side walls so as to prevent such section of the foldable sides from folding inwards. In other words, when the foldable side wall section tries to fold inwards, it would engage the first edge of its corresponding ramp which would prevent the side wall section from further inward movement. When the weight is off, however, and the handle is lifted, the top wall folds, the ramps also move with the top wall allowing each section of the foldable sides to slide along or relative to their corresponding ramp edge and fold.

In an example embodiment as shown in FIGS. 2 and 5, a tab 120 may extend from each section of the folding side walls for engaging the ramp first edge 102 when weight is on the stool and the side walls inadvertently attempt to fold towards the ramp. Also, when the stool is being folded, the tab may engage the ramp edge 104 and slide along it to as the side walls fold.

The walls described herein are hingeably coupled to each other using a wall known coupling mechanisms. For example, a hinge system similar to a door hinge using knuckles and pin(s) maybe used. Pins may extend from some of the knuckles or may be separate. In other example embodiments, external hinges may be used. In an example embodiment, each section of the folding support member has opposite projections 128, 130 extending along their corresponding axes 92, 94, in opposite directions, as for example seen in FIG. 3. These projections fit in complementary recesses or openings 132, 134 extending perpendicularly (or transversely) on walls 136, 138 which walls extend perpendicularly (or transversely) from their corresponding top wall first and second section lower surfaces 80, 82. The projections may be snap fitted in the complementary recesses or opening. In other example embodiments, the projections may be formed on the walls 136, 138 and the recess may be formed of the folding support member sections. Other known ways of hingedly coupling the folding support member is to the top wall first and second sections may also be used.

When in an unfolded useable state the folding step stool has a height 142 as measured from a surface 140 it is resting upon to the upper surface 76, 78 of the first and second section, respectively of the top wall that is not greater than 6 inches. In an example embodiment such height is not greater than 5 inches. In another example embodiment such height is not greater than 4 inches. In one example embodiment such height is about 3.875 inches. This height allows the folding step stool to be used as a step stool to be stepped upon when exiting a car, to help a less mobile person exit a vehicle, especially a vehicle such as a Sport Utility Vehicle that is higher off the ground.

Although only a few example embodiments have been described in detail above, those skilled in the art will readily appreciate that many modifications are possible in the example embodiments without materially departing from this invention. Accordingly, all such modifications are without materially departing from this invention. Accordingly, all such modifications are intended to be included within the scope of this disclosure as defined in the following claims. It is the express intention of the applicant not to invoke 35 U.S.C. 112, paragraph 6 for any limitations of any of the claims herein, except for those in which the claim expressly uses the words 'means for' together with an associated function.

What is claimed is:

1. A folding step stool comprising:

a foldable top wall comprising a first section hingeably coupled to a second section along a first axis;

a first side wall hingeably coupled to the first section;

a second side wall hingeably coupled to the second section;

a third foldable side wall comprising a first section hingeably coupled to a second section, wherein the third foldable side wall first section is hingeably coupled to the first side wall and wherein the third foldable side wall second section is hingeably coupled to the second side wall;

a fourth foldable side wall comprising a first section hingeably coupled to a second section, wherein the fourth foldable side wall first section is hingeably coupled to the first side wall and wherein the fourth foldable side wall second section is hingeably coupled to the second side wall; and a foldable supporting member comprising a first section hingeably coupled to the foldable top wall first section and comprising a second section hingeably coupled to the foldable top wall second section; and wherein the foldable supporting member first section is directly hingeably coupled to the foldable supporting member second section.

2. The folding step stool of claim 1, wherein the first side wall is hingeably coupled to the foldable top wall first section about a second axis generally parallel to the first axis and wherein the second side wall is hingeably coupled to the foldable top wall second section about a third axis generally parallel to the first axis.

3. The folding step stool of claim 2, wherein the first side wall is hingeably coupled to an end of the first section of the foldable top wall and wherein the second side wall is hingeably coupled to an end of the second section of the foldable top wall.

4. The folding step stool of claim 2, wherein the first section of the third foldable side wall is hingeably coupled to the first side wall about a fourth axis extending transversely relative to the second axis and wherein the second section of the third foldable side wall is hingeably coupled to the second side wall about a fifth axis extending transversely relative to the third axis.

5. The folding step stool of claim 4, wherein the first section of the fourth foldable side wall is hingeably coupled to the first side wall about a sixth axis extending transversely relative to the second axis and wherein the second section of the fourth foldable side wall is hingeably coupled to the second side wall about a seventh axis extending transversely relative to the third axis.

6. The folding step stool of claim 5, wherein the first section of the foldable third side wall is hingeably coupled to the second section of the foldable third side wall about an eight axis generally perpendicular relative to the first axis, and wherein the first section of the fourth foldable side wall is hingeably coupled to the second section of the fourth side wall about a ninth axis generally perpendicular relative to the first axis.

7. The folding step stool of claim 4, wherein the foldable top wall first and second sections comprise an upper surface for being stepped on when the foldable stool is in an unfolded useable state, and a lower surface opposite the upper surface, wherein the foldable supporting member is coupled to and extends from the lower surfaces of the first and second sections, and extends in a direction opposite the upper surface of the first and second sections.

8. The folding step stool of claim 1, wherein the first section of the top wall comprises a handle and wherein the second section of the top wall comprises a depression, wherein said handle is received in said depression when the folding step stool is in an unfolded state.

9. The folding step stool of claim 1, wherein the foldable top wall first and second sections comprise an upper surface for being stepped on when the foldable stool is in an unfolded useable state, and a lower surface opposite the upper surface, the folding step stool further comprising:

a first ramp extending from the lower surface adjacent to the first section of the third foldable side wall;

a second ramp extending from the lower surface adjacent the second section of the third foldable side wall;

a third ramp extending from the lower surface adjacent to the first section of the fourth foldable side wall; and a fourth ramp extending from the lower surface adjacent the second section of the fourth foldable side wall.

10. The folding step stool of claim 9, further comprising:

a first stop adjacent to the first ramp for blocking the first section of the third foldable side wall from pivoting past said first stop when the folding step stool is in a useable unfolded state;

a second stop adjacent to the second ramp for blocking the second section of the third foldable side wall from pivoting past said second stop when the folding step stool is in a useable unfolded state;

a third stop adjacent to the third ramp for blocking the first section of the fourth foldable side wall from pivoting past said third stop when the folding step stool is in a useable unfolded state; and a fourth stop adjacent to the fourth ramp for blocking the second section of the fourth foldable side wall from pivoting past said first stop when the folding step stool is in a useable unfolded state.

11. The folding step stool of claim 1, further comprising:

a first stop for blocking the first section of the third foldable side wall from pivoting past said first stop when the folding step stool is in a useable unfolded state;

a second stop for blocking the second section of the third foldable side wall from pivoting past said second stop when the folding step stool is in a useable unfolded state;

a third stop for blocking the first section of the fourth foldable side wall from pivoting past said third stop when the folding step stool is in a useable unfolded state; and a fourth stop for blocking the second section of the fourth foldable side wall from pivoting past said first stop when the folding step stool is in a useable unfolded state.

* * * * *